US005118211A

United States Patent [19]

Mecke et al.

[11] Patent Number: 5,118,211

[45] Date of Patent: Jun. 2, 1992

[54] THERMOCOLOR RIBBON

[75] Inventors: Norbert Mecke, Hanover; Heinrich Krauter, Neustadt, both of Fed. Rep. of Germany

[73] Assignee: Pelikan Aktiengesellschaft, Hanover, Fed. Rep. of Germany

[21] Appl. No.: 553,793

[22] Filed: Jul. 26, 1989

[30] Foreign Application Priority Data

Jul. 27, 1988 [DE] Fed. Rep. of Germany ..... 3825437

[51] Int. Cl.[5] ..... B41J 31/02

[52] U.S. Cl. ..... 400/241; 400/241.1; 428/195

[58] Field of Search ..... 400/120, 241, 241.1, 400/241.2, 241.4; 428/484, 488.1, 488.4, 913, 914, 195, 212

[56] References Cited

U.S. PATENT DOCUMENTS

| | | | |
|---|---|---|---|
| 4,895,465 | 1/1990 | Mecke et al. | 400/241.2 |
| 4,938,617 | 7/1990 | Mecke et al. | 400/241.4 |
| 4,983,445 | 1/1991 | Ueyama | 428/484 |
| 4,988,563 | 1/1991 | Wehr | 428/484 |

*Primary Examiner*—Edgar S. Burr
*Assistant Examiner*—Joseph R. Keating
*Attorney, Agent, or Firm*—Herbert Dubno

[57] ABSTRACT

The color transfer density of a thermocarbon ribbon can be improved by forming the wax phase of a melt color layer of such a ribbon so that it contains a paraffin with a hardening temperature of about 50 to 110° C. and at least one ethylene-vinylacetate wax forming a eutectic with a paraffin.

4 Claims, No Drawings

THERMOCOLOR RIBBON

CROSS REFERENCE TO RELATED APPLICATIONS

This application is related to our commonly owned copending applications Ser. No. 07/109,489 filed 15 Oct. 1987; Ser. No. 07/154,651 filed 10 Oct. 1988; Ser. No. 07/152,641 filed 5 Feb. 1988; Ser. No. 07/272,599 filed 16 Nov. 1988; and Ser. No. 07/351,624 filed 12 May 1989. Reference may also be had to the concurrently filed application Ser. No. 07/553,794 filed 26 Jul. 1989.

FIELD OF THE INVENTION

Our present invention is related to a thermocolor ribbon, especially a thermocarbon ribbon, which can, as described in the aforementioned copending applications, have a flexible carrier of the type described therein, e.g. a paper or plastic foil sheet or film, provided on one side with a coating of a melt color forming a color transfer layer and containing pigments and, optionally, coloring agents such as dyestuffs and possibly other additives.

BACKGROUND OF THE INVENTION

Thermocolor ribbons have long been known. They generally comprise a foil-like carrier or support, for example of paper, a plastic or the like, and a melt color which can be composed of a plastic-bonded and/or wax-bonded coloring agent or carbon black.

The melt color of the thermocolor ribbons is brought into a molten state by a thermal printing head which heats the melt color and causes transfer of a molten portion locally to a substrate which can be a printer paper.

Thermal printers and thermal printer heads which can be used for this purpose are described, for example, in the German Patent Documents DE-AS 20 62 494 and DE-AS 24 06 613 as well as De-OS 32 24 445.

In the thermal printing head of a printer, heated points or pins can define a symbol to be printed, e.g. an alphanumeric symbol which is to be applied in the form of a corresponding pattern of the melt color to a paper sheet. The thermal printing head presses the thermocolor ribbon against the paper to be imprinted. The heated alphanumeric symbol of the thermal printing head applies a temperature of about 400° C. to the thermocolor ribbon to locally melt the color transfer layer at the heated locations and cause transfer to the paper sheet at these locations at which the paper sheet contacts the ribbon.

The used part of the thermocolor ribbon is taken up on a spool.

The thermocolor ribbon can have a variety of melt colors next to one another. With the combination of the basic colors blue, yellow and red, for example, colored images can be printed. This system has a significant advantage over conventional color photography since the development and fixing steps required for such photography can be eliminated.

Thermal printers can operate with high writing speeds, for example, to print a German Industrial Standard DIN A4 page in about 10 seconds, without significant noise generation.

Apart from this kind of thermal ribbon, there is also a thermal ribbon which does not require the formation of a heated symbol on a thermal printing head to effect the transfer of the melt color to the substrate.

With such a ribbon, the melt color is heated by resistance heating generated by a specially formed foil-like carrier. The heat is generated by passing an electric current through the latter and the melt color and/or the carrier must contain electrically conductive materials. Apart from such electrically conductive materials, however, the melt color has the composition previously described. In the field, this type of ribbon is referred to as an ETR material, namely, an electrothermal ribbon. A Thermal transfer printing system using this ribbon is described, for example, in U.S. Pat. No. 4,309,117.

It has been found that many thermocarbon ribbons of the above-described type have unsatisfactory covering power during the printing process. In other words, the optical density of the image produced on the substrate, i.e. the receiving paper sheet, leaves much to be desired.

OBJECTS OF THE INVENTION

It is, therefore, the principal object of the present invention, to provide a thermocolor ribbon which has an especially high optical density of print transfer to the substrate. Another object of this invention is to provide an improved thermocolor ribbon, especially a thermocarbon ribbon, which avoids the drawbacks of earlier systems and is capable of transferring with high resolution, optically dense prints to the substrate.

It is also an object of this invention to extend the principles of the above-described copending applications so as to further improve on the printing qualities of a thermocolor ribbon.

DESCRIPTION OF THE INVENTION

These objects and others which will become apparent hereinafter are attained, in accordance with the invention, by incorporating in the melt color of the thermocolor ribbon at least one paraffin with a hardening temperature of about 50° to 110° C. and at least one ethylene vinyl acetate wax capable of forming a eutectic with the paraffin.

An important component of the melt color of the thermocolor ribbon of the invention is, therefore, a paraffin which is capable of melting at a temperature within the range of 50° to 110° C., preferably about 60° to 95° C. The paraffin can be a solid high-purity mixture of saturated aliphatic hydrocarbons which are colorless, tasteless and odorless, which are readily soluble in diethylether and chloroform and are not soluble in water and 90% ethanol. The paraffinic materials which fall into this category can include microcrystalline wax, ceresin, petroleum waxes and Fischer-Tropsch waxes.

An important component of the melt color of the invention is that the ethylene-vinylacetate wax which forms with the paraffin wax upon cooling of a homogeneous melt formed therewith with formation of a eutectic, or it can be a mixture of the eutectic with one of the two pure wax components. Of course, other components of the melt color can be dispersed or dissolved therein. It has been found, quite surprisingly, that when the formation of a eutectic is ensured in the melt color, the aforedescribed objects are attained in that there is far more dense color transfer to the paper sheet from the heated melt color at a given temperature and for a given proportion of pigments or other coloring agents in this melt color layer.

The ethylene-vinylacetate wax should have a melting point of 87° to 92° C., a hardening point of about 83° to 97° C., a mean molecular weight of about 6500 to 7000 and a vinylacetate content of about 9 to 11 weight percent. A preferred capable of forming the eutectic with this paraffinic wax material, a variety of conventional additives can be incorporated in the melt color. These can include ester waxes and/or modified hydrocarbon resins which reduce viscosity of the melt color during the thermal printing process and thus improve the flow properties of the transferred material.

The melt color of the thermocarbon ribbon must contain at least one pigment which, in the case of a thermocarbon ribbon will be carbon black. However, other pigments and coloring agents such as dyestuffs, may be included in the melt color layer as well. The usual definition distinguishing pigments and dyestuffs is applicable here, pigments being generally insoluble particulate materials whose color is carried over into the color transfer layer and into the transferred symbol, while the dyestuffs may be soluble substances which can be dissolved in the matrix phase and in the melt during the transfer. Both pigments and dyestuffs, of course, are intended where the term "coloring agent" is used herein.

The effect of the present invention appears to result from a new relationship between the pigments and the matrix phase, especially in the case of carbon black. It has been observed by microscopic analysis that during the formation of the eutectic from the melt, pigment particles appear to agglomerate and this agglomeration may be a contributory factor in the greater density of the transferred symbol, since the eutectic is reformed as the melt cools in the transferred symbol.

A microscopic analysis of the thermocarbon ribbon and especially a melt color formed thereon from the melt also shows the formation of nests of pigment in addition to regions which may be somewhat devoid of carbon black. Naturally, dyestuffs can further increase the depth of color transferred or can be used to impart other colors to the color transfer layer.

SPECIFIC EXAMPLES

The following examples, emphasizing the composition of the melt color, are provided as illustrative of the invention.

EXAMPLE 1

On a conventional polyester carrier of a thickness of 4 micrometers, a color transfer layer is applied at a temperature of 120° C. by means of a Flexoprinter so that the hardened melt color has a thickness of about 4 micrometer. The melt is formed by heating a composition of about 40 parts by weight of ethylene-vinylacetate wax with a melting point of 87° to 92° C., a hardening point of about 83° to 92° C., an average molecular weight of about 6500 to 7000 and a vinylacetate content of 9 to 11 weight percent, about 45 parts by weight of paraffin with a melting point of about 70° C. and about 20 parts by weight of carbon black to the aforementioned temperature of 120° C. After hardening at room temperature, the resulting thermocarbon ribbon was tested and found to provide thermally printed symbols on printer paper with a deeper black coloration than could be achieved with earlier thermocarbon ribbons.

EXAMPLE 2

Example 1 was followed except that the melt color had the following composition: 30 parts by weight ethylene-vinylacetate wax, 15 parts by weight carbon black, about 45 parts by weight paraffin wax and about 5 parts by weight ester wax to improve the flow characteristics on thermal printing. Similarly, high density prints were obtained.

If desired, an adhesive layer promoting transfer of the melt color to the substrate can be provided on the melt color layer in the form of a combination of paraffin and a tackifying resin.

We claim:

1. A thermocarbon ribbon comprising a thermocarbon ribbon carrier and a melt color on one side of said carrier, said melt color containing a pigment and a wax phase in which said pigment is distributed, said wax phase comprising 40 to 90 weight percent of a paraffin with a hardening temperature of about 50° to 110° C. and 10 to 60 weight percent ethylene-vinylacetate wax which forms a eutectic with the paraffin, said ethylene-vinylacetate wax having a melting point of about 87° to 92° C., a hardening point of about 83° to 92° C., a mean molecular weight of about 6500 to 7000 and a vinylacetate content of about 9 to 11 percent by weight.

2. The thermocarbon ribbon defined in claim 1 wherein said pigment is carbon black.

3. The thermocarbon ribbon defined in claim 2 wherein said melt color further includes at least one component capable of improving flow of the melt color during thermal printing and selected from the group which consists of ester wax, modified hydrocarbon resins and mixtures thereof.

4. The thermocarbon ribbon defined in claim 1 further comprising an adhesive layer on said melt color for improving transfer of the melt color during thermal printing and consisting of a paraffin and a tackifying resin.

* * * * *